US007870736B2

(12) United States Patent
Homitz et al.

(10) Patent No.: US 7,870,736 B2
(45) Date of Patent: Jan. 18, 2011

(54) PREMIXING INJECTOR FOR GAS TURBINE ENGINES

(75) Inventors: Joseph Homitz, Orlando, FL (US); David M. Sykes, Midlothian, VA (US); Walter F. O'Brien, Blacksburg, VA (US); Uri Vandsburger, Blacksburg, VA (US); Steve LePera, Blacksburg, VA (US)

(73) Assignees: Virginia Tech Intellectual Properties, Inc., Blacksburg, VA (US); Electric Jet, LLC, Blacksburg, VA (US)

( * ) Notice: Subject to any disclaimer, the term of this patent is extended or adjusted under 35 U.S.C. 154(b) by 851 days.

(21) Appl. No.: 11/757,210

(22) Filed: Jun. 1, 2007

(65) Prior Publication Data

US 2007/0277528 A1 Dec. 6, 2007

Related U.S. Application Data

(60) Provisional application No. 60/810,083, filed on Jun. 1, 2006.

(51) Int. Cl.
*F02C 1/00* (2006.01)
*F02G 3/00* (2006.01)

(52) U.S. Cl. ..... 60/737; 60/740; 239/533.2

(58) Field of Classification Search ..... 60/737, 60/740, 742, 746, 747; 239/533.2
See application file for complete search history.

(56) References Cited

U.S. PATENT DOCUMENTS 1,983,644 A 10/1931 Sonner
1,927,422 A 9/1932 Sonner
4,587,809 A 5/1986 Ohmori et al.
5,402,633 A 4/1995 Hu
5,505,615 A 4/1996 Witteveen
5,671,597 A 9/1997 Butler et al.
5,675,971 A * 10/1997 Angel et al. ..... 60/746
5,713,205 A 2/1998 Sciocchetti et al.
5,735,681 A 4/1998 Cheng
6,070,410 A 6/2000 Dean
6,070,411 A * 6/2000 Iwai et al. ..... 60/737

(Continued)

FOREIGN PATENT DOCUMENTS

JP 2 749 927 A1 6/1996

OTHER PUBLICATIONS

Dahl, G., et al. "Engine Control and Low-NOx Combustion for Hydrogen Fuelled Aircraft Gas Turbines," Int. J. Hydrogen Energy, 1998, vol. 23, No. 8, pp. 695-704.

(Continued)

*Primary Examiner*—William H Rodriguez
(74) *Attorney, Agent, or Firm*—Charles S. Sara, Esq.; DeWitt Ross & Stevens S.C.

(57) ABSTRACT

A premixing injector for use in gas turbine engines assists in the lean premixed injection of a gaseous fuel/air mixture into the combustor of a gas turbine. The premixing injector is designed to mix fuel and air at high velocities to eliminate the occurrence of flashback of the combustion flame from the reaction zone into the premixing injector. The premixing injector includes choked gas ports, which allow the fuel supply to be decoupled from any type of combustion instability which may arise in the combustor of the gas turbine and internal passages to provide regenerative cooling to the device.

16 Claims, 7 Drawing Sheets

U.S. PATENT DOCUMENTS

| | | | | |
|---|---|---|---|---|
| 6,082,111 | A | 7/2000 | Stokes | |
| 6,141,967 | A | 11/2000 | Angel et al. | |
| 6,199,368 | B1 * | 3/2001 | Onoda et al. | 60/39.463 |
| 6,267,585 | B1 | 7/2001 | Suttrop | |
| 6,282,904 | B1 * | 9/2001 | Kraft et al. | 60/739 |
| 6,301,899 | B1 | 10/2001 | Dean et al. | |
| 6,311,473 | B1 | 11/2001 | Benjamin et al. | |
| 6,438,961 | B2 | 8/2002 | Tuthill et al. | |
| 6,461,147 | B1 | 10/2002 | Sonju et al. | |
| 6,513,329 | B1 | 2/2003 | Snyder et al. | |
| 6,786,047 | B2 | 9/2004 | Bland et al. | |
| 6,889,495 | B2 | 5/2005 | Hayashi et al. | |
| 6,901,756 | B2 | 6/2005 | Gerendas et al. | |
| 6,907,724 | B2 | 6/2005 | Edelman et al. | |
| 6,925,809 | B2 | 8/2005 | Mowill | |
| 6,951,108 | B2 | 10/2005 | Burrus et al. | |
| 6,968,692 | B2 | 11/2005 | Chin et al. | |
| 6,978,619 | B2 | 12/2005 | Blomeyer | |
| 7,013,648 | B2 | 3/2006 | Griffin et al. | |
| 7,013,649 | B2 | 3/2006 | Monty | |
| 7,093,445 | B2 | 8/2006 | Corr, II et al. | |
| 7,117,679 | B2 * | 10/2006 | Toon et al. | 60/740 |
| 7,165,405 | B2 * | 1/2007 | Stuttaford et al. | 60/737 |
| 7,568,345 | B2 * | 8/2009 | Furletov et al. | 60/742 |
| 7,707,833 | B1 * | 5/2010 | Bland et al. | 60/737 |
| 7,757,491 | B2 * | 7/2010 | Hessler | 60/746 |
| 2002/0162333 | A1 * | 11/2002 | Zelina | 60/776 |
| 2010/0077760 | A1 * | 4/2010 | Laster et al. | 60/742 |

OTHER PUBLICATIONS

Fritz, J., et al. "Flashback in a Swirl Burner with Cylindrical Premixing Zone," Journal of Engineering for Gas Turbines and Power, 2004, vol. 126, pp. 276-283.

Kurosawa, Y., et al., "Structure of Swirler Flame in Gas Turbine Combustor," 2001, Fifteenth International Symposium on Air Breathing Engines, Bangalore, India.

Lovett, Jeffrey A., et al. "Development of a Swirl and Bluff-Body Stabilized Burner for Low-NOx, Lean-Premixed Combustion," 1995, presented at the International Gas Turbine and Aeroengine Congress and Exposition.

Marek, C. John, et al., "Low Emission Hydrogen Combustors for Gas Turbines Using Lean Direct Injection," 2005, 41st AIAA/ASME/SAE/ASEE Joint Propulsion Conference and Exhibit.

McVey, J.B., et al., "Evaluation of Low-NOx Combustor Concepts for Aeroderivative Gas Turbine Engines," Journal of Engineering for Gas Turbines and Power, 1993, vol. 115, pp. 581-587.

Samuelson, G.S., et al., "Characterization of Flameholding Tendencies in Premixer Passages for Gas Turbine Applications," 2004, 40th AIAA/ASME/SAE/ASEE Joint Propulsion Conference and Exhibit.

Straub, Douglas L., et al. "Effect of Fuel Nozzle Configuration on Premix Combustion Dynamics," 1998, presented at the International Gas Turbine & Aeroengine Congress & Exposition.

* cited by examiner

PREMIXING INJECTOR FOR GAS TURBINE ENGINES

REFERENCE TO RELATED APPLICATION

Priority is hereby claimed to provisional application Ser. No. 60/810,083, filed Jun. 1, 2006, which is incorporated herein by reference.

FIELD OF THE INVENTION

This disclosure relates to the field of combustion turbine engines. Specifically, the described devices can be used as a means of efficiently utilizing an alternative fuel, e.g., hydrogen, gas turbines while keeping the generation and emissions of nitrogen oxides to very low levels. More specifically, the present invention is a fuel/air premixing fuel injector or "premixing injector" which supports combustion in gas turbines with control of nitrogen oxide production.

DESCRIPTION OF THE PRIOR ART

Hydrogen use as a fuel in gas turbine engines has many benefits. In addition to being a renewable fuel, there are no carbon emissions from hydrogen combustion. Of available gas turbine fuels, hydrogen allows the widest range of combustible fuel-air mixtures, thus providing a superior opportunity for reduced flame temperature lean combustion.

In a typical gas turbine engine, the combustion chamber, fuel delivery system, and control system are designed to ensure that the correct proportions of fuel and air are injected and mixed within one or more combustors, typically a metal container, or compartment, where the fuel and air are mixed and burned. With diffusion flames in the combustor, there is typically a set of localized zones where peak combustion temperatures are achieved. These peak temperatures may reach temperatures in the range of 4000-5000° F.

Typically, to prevent thermal distress or damage to these combustors, a significant amount of the compressor discharge air passes along and through the walls of the combustor for cooling, and to dilute the exhaust gases. The heated compressed air, which then drives the turbine, is a combined mix of the hot combustion gasses and the cooling air. The resulting hot gas yield, which is admitted to the inlet of the turbine, is delivered at a very high temperature. The resultant products and emissions from the hydrogen combustion process are water vapor and oxides of nitrogen ($NO_x$), a known pollutant, which is exhausted into the atmosphere. $NO_x$ is a harmful product of combustion, and is regulated by environmental laws. Low $NO_x$ emission is a goal, and in many cases, a requirement for both power generation and aero propulsion gas turbines.

One method for controlling $NO_x$ formation in the combustion processes of gas turbine engines is to premix the compressor discharge air and the fuel in a premixing injector before they enter the combustor. In this manner, the medium entering the combustion chamber is a homogeneous mixture of the fuel and compressor discharge air. This will allow lean combustion, keeping the combustion product temperature low, which reduces $NO_x$ formation.

Multiple efforts have been made for the design of premixing injectors for gaseous hydrocarbon fuels, but very few designs have been made for operation with hydrogen fuel. In addition to achieving optimal fuel/air mixture, the issue of premixed flame stabilization in the proper position is paramount to avoid structural damage to the premixing injector and combustor. Challenges of conventional premixing designs include prevention of flashback and design flow breakdown in the premixing injectors. The term "flashback," as used in this disclosure refers to the ignition and combustion of the fuel-air mixture within the premixing injector discharge channel, rather than in the combustor. A sustained flashback event will damage the premixing injector.

SUMMARY OF THE INVENTION

The present invention involves a unique lean premixing injector for a gas turbine engine which provides stable hydrogen fuel combustion with low $NO_x$ production to solve the aforementioned problems associated with existing technology. These premixing injectors incorporate:

- swirl for uniform fuel-air premixing and flame stabilization that supports low equivalence ratio combustion and low $NO_x$ production;
- choked fuel injection for isolation of combustion pressure oscillations from the fuel injection system;
- geometry that provides no internal flame holding sites for fuel-air combustion, thus preventing flashback;
- an integral bluff body flame holding site external to the injector, which is provided as a feature of the overall design concept; and
- internal channel structure designed to create internal regenerative cooling to improve the lifespan and preserve the longevity of the premixing injector.

In order to illustrate some of the unique features of the invention, the following is a brief summary of the preferred versions of the injector. More specific details regarding the preferred version are found in the Detailed Description with further reference to the Drawings. The claims at the end of this document define the various versions of the invention in which exclusive rights are secured.

Reference is now made to the attached FIGS. 1-6 for exemplary embodiments of the premixing injector of the present invention. The premixing injector, depicted in assembly, exploded, and sectional views as 10 in FIGS. 1-3 and 10*a* in FIGS. 4-6, is shown in two embodiments with Embodiment 1 illustrated at 10 in FIGS. 1-3 and Embodiment 2 illustrated at 10*a* in FIGS. 4-6. Similar structures in each embodiment will be referenced by the same reference numbers with the reference numbers in Embodiment 2 being followed by a lowercase "a."

The premixing injector 10, 10*a* includes an outer casing 12, 12*a* having a first inlet end 14, 14*a* and a second outlet end 16, 16*a*. The outer casing 12, 12*a* surrounds a center body 20, 20*a*, which includes a first open end 22, 22*a* extending from the first end 14, 14*a* of the outer casing 12, 12*a*, a second closed end 24, 24*a* at the second end 16, 16*a* of the outer casing 12, 12*a*, an exterior wall 26, 26*a*, an interior wall 28 (illustrated in FIG. 3), 28*a* and an endcap 30. An exterior annular mixing channel 40, 40*a* is defined by the exterior wall 26, 26*a* of the center body 20, 20*a* and the interior wall 18, 18*a* of the outer casing 12, 12*a*. The mixing between the compressor discharge air and the fuel occurs in the exterior annular mixing channel 40, 40*a*. The area of the exterior annular mixing channel 40, 40*a* is constant over the length of the premixing injector 10, 10*a* to discourage low velocity regions and thus flashback within the premixing injector. A unique feature of the present design is that there are no bluff bodies or flow separation zones within the premixing injector downstream of the fuel injection point to provide flame holding for a flashback. Thus, flashback is discouraged, and easy recovery is provided should a transient flashback occur.

The center body 20, 20*a* also includes a fuel inlet duct 42, 42*a* having a first inlet end 44, 44*a*, a second outlet end 46, 46*a*, and an open passageway 48, 48*a* extending from the first inlet end 44, 44*a* to the second outlet end 46, 46*a*. The fuel inlet duct 42, 42*a* extends to the second end 24, 24*a* of the center body 20, 20*a*.

As illustrated in FIGS. 2 and 5, the center body 20, 20*a* is further defined by an annular sleeve 23, 23*a* positioned on the center body 20, 20*a* at the first open end 22, 22*a*. In Embodiment 1, the annular sleeve 23 is solid, as the airflow enters the bell mouth air inlet ducts 60. Swirl is generated by the tangential velocity component of the air produced by the angled location of the air inlet(s). The fuel enters through choked fuel injector ports 54, 54*a*.

In Embodiment 2, the annular sleeve 23*a* is hollow, allowing air to enter the swirler region 70*a*, which generate the required swirl. Fuel is introduced downstream of the swirler region 70*a* through choked fuel injector ports 54*a*. Referring specifically to FIG. 5, it is noted that the annular sleeve 23*a* is normally in a position covering the vanes 74 situated on the center body 20. To allow disclosure of the vane 74 in FIG. 5, the annular sleeve has been positioned at the second end 46*a* of the center body 20*a*. FIG. 6 illustrates the correct located of annular sleeve 23*a*.

As illustrated in FIGS. 3 and 6 in the assembled version of the premixing injector 10, 10*a*, the fuel inlet duct 42, 42*a* is positioned within the center body 20, 20*a* in such a manner as to form an interior fuel channel 50, 50*a* which is connected to the open passageway 48, 48*a* by a conduit 52, 52*a*. The interior fuel channel 50, 50*a* extends longitudinally and in parallel alignment with the exterior annular channel 40, 40*a* from the conduit 52, 52*a* to a choked fuel injection port 54, 54*a*. The choked fuel injection port 54, 54*a* allows the introduction of fuel to the exterior annular mixing channel 40, 40*a*. In addition, the choked fuel injection port 54, 54*a* inhibits any backflow of fuel and/or air into the upstream portion of the premixing injector 10, 10*a*.

In this manner, fuel is introduced into the premixing injector 10, 10*a* by way of the passageway 48, 48*a* of the fuel inlet duct 42, 42*a* at the inlet end 44, 44*a*. The fuel is then directed to the interior fuel channel 50, 50*a* by way of the conduit 52, 52*a*.

A unique aspect of this system is that the flow of fuel through the conduit allows the cooler fuel gas to cool the closed second end 24, 24*a* of the center body 20, 20*a*. As can be seen in FIGS. 3 and 6, the passageway 48, 48*a* directs fuel to the endcap 30, 30*a* of the center body 20, 20*a* where heat radiated and convected from the combustion flame will be transferred from the endcap 30, 30*a* of the center body 20, 20*a* into the fuel gas. The fuel will then continue to flow by way of the conduit 52, 52*a* to the interior fuel channel 50, 50*a* and through the choked fuel injection ports 54, 54*a* where the fuel will be introduced into the exterior annular mixing channel 40, 40*a* through the choked fuel injection ports 54, 54*a*. The mass flow of the gaseous fuel is used to cool the center body 20, 20*a* as a regenerative effect.

From the choked fuel injection port 54, 54*a*, the fuel then enters the swirling region 70 of the exterior annular mixing channel 40, 40*a* through the choked fuel injection ports 54, 54*a* where the fuel is mixed with the passing compressor discharge air which enters the premixing injector 10 via the air inlet ports 60, 60*a*. The choked fuel injection ports 54, 54*a* are by design choked, thereby decoupling the fuel delivery system from downstream pressure fluctuations. In Embodiment 1 (FIGS. 1-3), the choked fuel injection ports 54 are oriented to inject the fuel in the axial outwardly direction. In Embodiment 2 (FIGS. 4-6), the choked fuel injection ports 54*a* are oriented to inject the fuel in the radially outward direction. The choked fuel injection ports 54, 54*a* are designed to be aerodynamically choked during all modes of operation of the gas turbine engine. Advantageously, this eliminates the chance of combustion instabilities coupling to the fuel supply.

The air inlet ports of the premixing injector 10 of Embodiment 1 include at least one and preferably four air inlet ducts 60 for channeling compressor discharge air to the exterior annular mixing channel 40. By design, the location of the air inlet duct 60 advantageously turns the external flow of air gradually into the premixing injector 10 in order to minimize pressure losses due to a sudden contraction.

In Embodiment 2, air inlet is accomplished with a single bell mouth-shaped air inlet duct 60*a* on the annular sleeve 23*a* and outer casing 12*a* which introduces the air well upstream of where the flow enters the guide vanes 74. The annular sleeves 23*a* may be fabricated integrally with the center body 20*a* without change to the operating principles of the premixing injector 10*a*.

Another significant feature of the premixing injector 10, 10*a* is that the closed second end 24, 24*a* of the center body 20, 20*a* ends in relatively the same plane as the second end 16, 16*a* of the outer casing 12, 12*a*. This feature allows the flame within the combustor chamber 90 (FIG. 7) to stabilize near the second end 24, 24*a* of the center body 20, 20*a* by providing a low-pressure wake region, which supports the flame holding vortex shear layer previously described.

The premixing injector 10, 10*a* also includes a swirler region 70, 70*a* for mixing the fuel and the compressor discharge air in the exterior annular mixing channel 40, 40*a*, and an outlet 80, 80*a* for expelling the thoroughly swirled and mixed fuel and air to the combustor 90.

Referring now to Embodiment 1, illustrated in FIGS. 1-3, the swirler region 70 is comprised of a series of air inlet ducts 60 extending from the outer casing 12 of the premixing injector 10 to the external annular mixing channel 40 downstream of the choked fuel injection ports 54.

Referring to Embodiment 2, illustrated in FIGS. 4-6, the swirler region 70*a* is defined by a series of serpentine guide vanes 74 positioned within the swirler region 70*a* formed by the outer casing 12*a* and the center body 20*a* and extending axially to the exterior annular mixing channel 40*a*. The trailing edge 77 of the guide vanes 74 includes a discharge angle preferably determined with respect to the axis of the outer casing 12*a*. The guide vane discharge angles are defined by a selected radial equilibrium condition to be substantially 45-60 degrees with respect to the axis of the outer casing 12*a* of the premixing injector 10*a*. The guide vanes 74 are intended to impart a tangential velocity component (swirl) to the incoming air and to provide structural support for the center body 20*a*.

Both the premixing injector 10, 10*a* of Embodiment 1 and Embodiment 2 are intended for injection of a lean premixed gaseous hydrogen fuel/air mixture into the combustor region 90 of a gas turbine engine; however, natural gas or any other gaseous fuel can be used with the premixing injectors of the present invention. The combustible mixture produced by both designs is predicted to have a uniformly distributed fuel-to-air mass ratio at the exit 80, 80*a* of the premixing injector 10, 10*a*. The lean premixed combustion of the mixture produces lower combustion temperatures than diffusion combustion of the fuel and air. These lower temperatures produce low $NO_x$ levels in the products of the combustion. The premixing injector 10, 10*a* is also designed to mix the fuel and air at high axial velocities to eliminate the occurrence of flashback of the reaction zone into the premixing injector 10, 10*a*.

An additional unique aspect of the present invention is that the premixing injector 10, 10*a* has the feature of cooling the closed end 24, 24*a* of the center body 20, 20*a* as discussed previously. This feature reduces the thermal loading on the center body 20, 20*a*, which will prolong the life of the premixing injector 10, 10*a*.

An additional unique feature of the present invention is that the premixing injector 10, 10*a* is designed with choked fuel inlet ports 54, 54*a*. This choked feature allows the fuel supply to be decoupled from any type of combustion instability which may arise in the combustor of the engine.

Another unique feature of the present invention is that the passage of the air from the air inlet duct 60, 60*a* to the exterior annular mixing channel 40, 40*a* has been designed to reduce pressure losses that may occur when air enters the exterior annular mixing channel 40, 40*a*. For Embodiment 1 of the current invention, this is accomplished by a smooth flared air inlet duct 60, which gradually accelerates the air flow. For Embodiment 2, this is accomplished with the annular sleeve 23*a* on the elongated center body 20*a* and a bell mouth-shaped rounded edge on the air inlet ducts 60*a* that extends in front of the swirl vanes 74.

Another significant advantage of the premixing injector of the present invention is that the second closed end 24, 24*a* of the center body 20, 20*a* ends in the same plane as the second end 16, 16*a* of the outer casing 12, 12*a*. This feature allows for a flame stabilization zone past the end of the premixing injector 10, 10*a*.

Furthermore, the premixing injector 10*a* is designed with a mathematically specified radial equilibrium constraint on the guide vanes 74. This feature alone allows for a large decrease in pressure losses through the premixing injector 10*a* and control of the axial velocity profile as compared to vanes without this constraint. This feature also creates a desirable axial velocity distribution across the exterior annular mixing channel 40*a*.

Summarizing the invention, unique fuel/air premixing injectors have been conceived and developed for the purpose of supporting fuel and compressor discharge air injection as the medium for combustion, resulting in the production of single digit parts per million (ppm) levels of $NO_x$ as a by-product, a wide range of stable operation, and suitability for integration into gas turbines.

In view of the foregoing, this disclosure relates to unique operation of the invention in the field of combustion in gas turbine engines. More specifically, the invention can be used as a means of utilizing alternative fuels that will perform in gas turbines while keeping emissions of nitrogen oxides below established target levels.

The features and advantages of the invention will be illustrated more fully in the following detailed description of the preferred embodiment of the invention made in conjunction with the accompanying drawings.

DETAILED DESCRIPTION OF THE INVENTION

Figure 1:
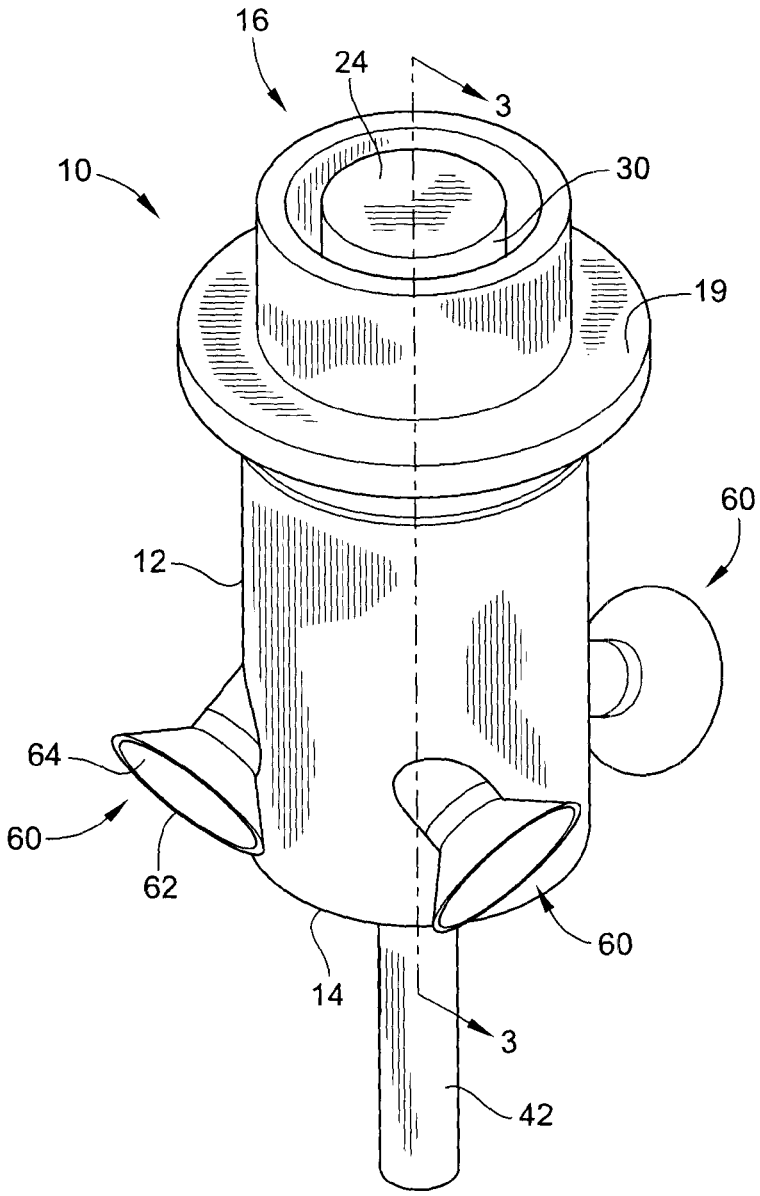
FIG. 1 is a perspective view showing the overall design of the first embodiment of the premixing injector of the present invention ("Embodiment 1").
Figure 2:
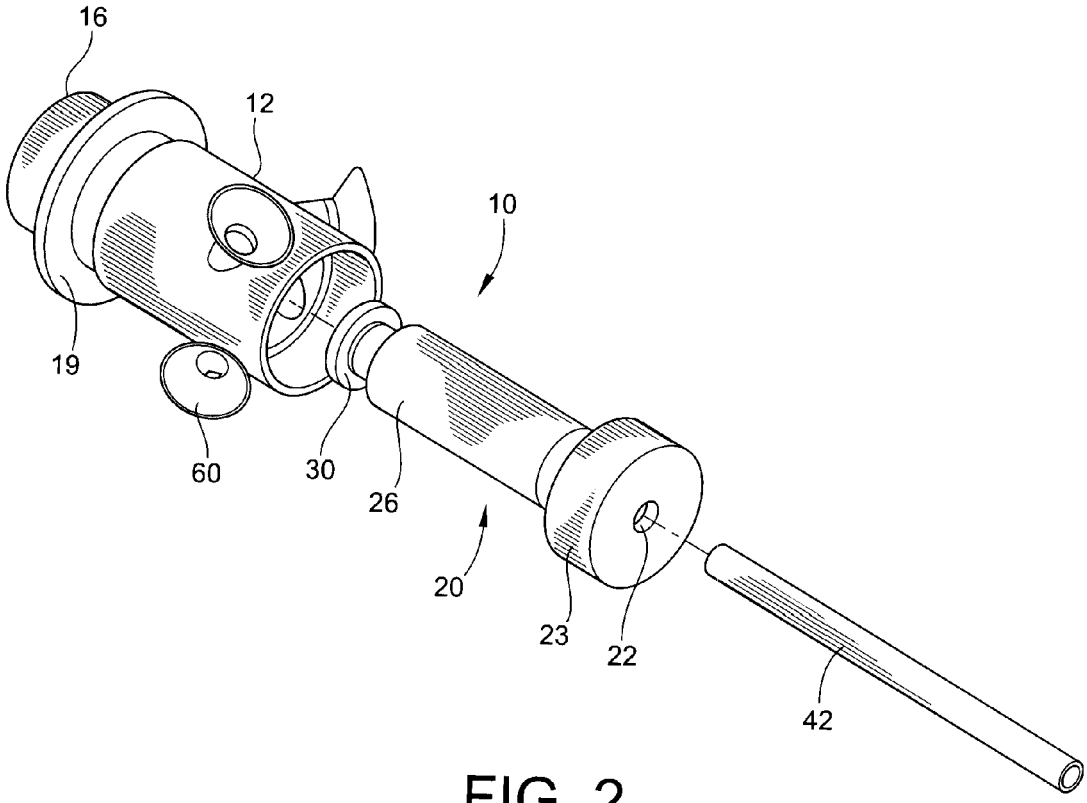
FIG. 2 is an exploded view of the premixing injector of FIG. 1.
Figure 3:
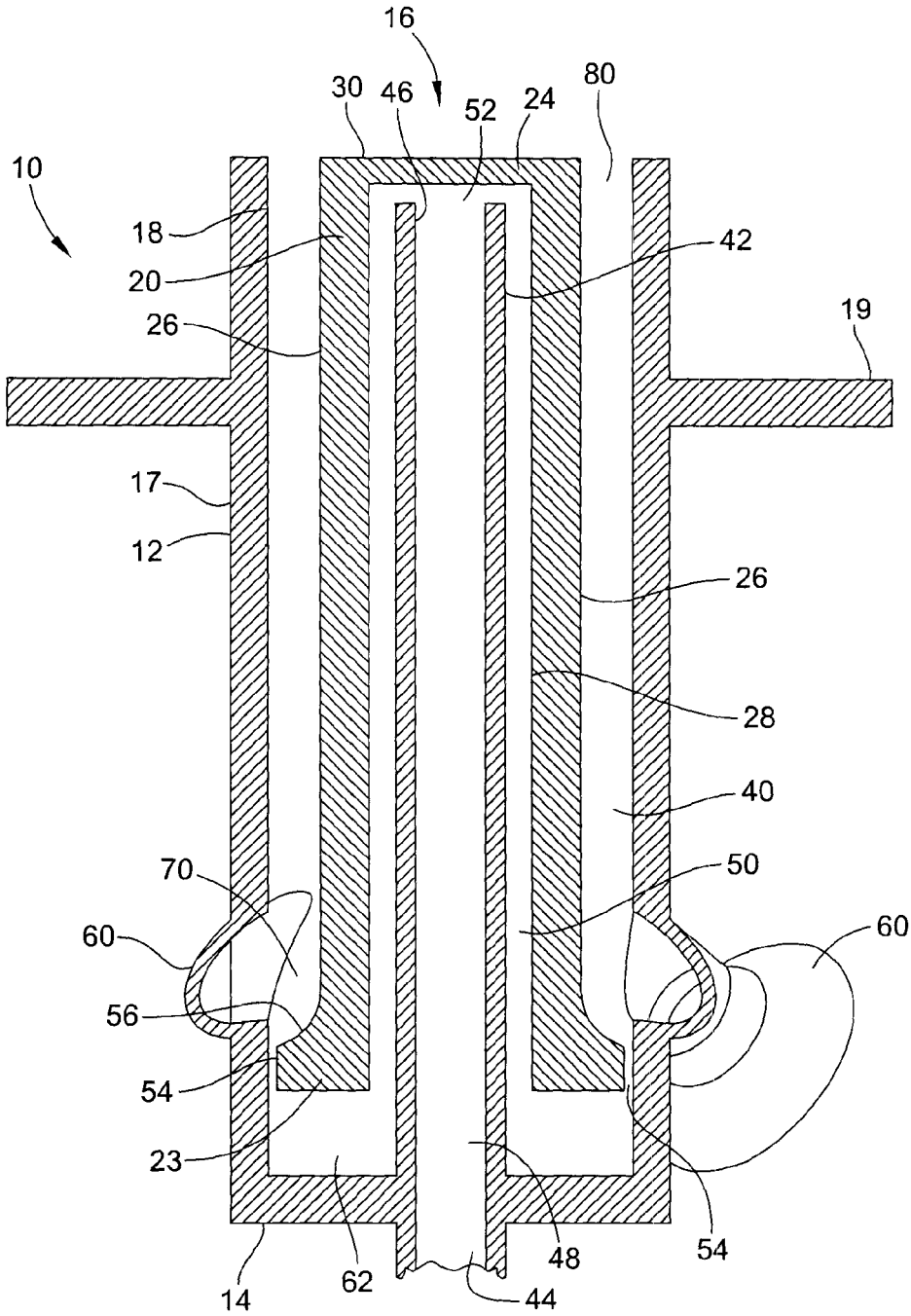
FIG. 3 is a cross-sectional view of the premixing injector of FIG. 1 taken along lines 3-3 of FIG. 1.

As previously noted, Embodiment 1 of the present invention, referenced in FIGS. 1-3, uses a combination of an angled air jet producing tangential and axial velocity components in the mixing region to achieve the condition of a premixed swirl stabilized flame. It was determined that for the correct balance of pressure losses and mixing, a hybrid scheme of a jet in crossflow and a jet in coflow should be used. A jet in crossflow is defined as a seeder stream (generally fuel) being injected perpendicular to the bulk stream (generally air). A jet in coflow is defined as the seeder stream and the bulk stream in a coaxial configuration. The hybrid scheme means that the angle between the two streams is between 0 and 90 degrees. In this embodiment, the angle was set at 60 degrees. This design is well-suited for most gas turbine engines because it is adaptable to standard combustor designs and, with the predicted operation, will keep the production of $NO_x$ low and produce a properly stabilized flame.

Referring to FIGS. 1-3, the premixing injector 10 of the present invention is defined by the exterior annular mixing channel 40 comprising three main structures: the outer casing 12, the center body 20 and the air inlet duct 60. The center body 20 is nested within the outer casing 12, and the air inlet duct 60 is nested within the center body 20 to form the premixing injector 10. Preferably, the three parts to the premixing injector 10 are welded together to form the single unit premixing injector 10.

As illustrated in FIGS. 1-3, the outer casing 12 is a generally cylindrical tube having a first inlet end 14, a second outlet end 16, and an external surface 17 and an internal surface 18. The outer casing 12 includes a flange 19, which allows the attachment of the premixing injector 10 to a gas turbine engine combustor liner 91 (FIG. 7) by bolts or other means. It is within the scope of the present invention to have other means for attaching the premixing injector 10 to the gas turbine engine combustor line 91. As illustrated in FIG. 1, the attachment flange 19 is situated near the second outlet end 16 of the outer casing 12.

Embodiment 1 illustrates four tangential circular air inlet ducts 60, which serve as the inlet stream of air (or other oxidizer), which is to be fed from a compressor or another source (not illustrated). The ends 62 of the air inlet ducts 60 are flared at an angle, preferably 45 degrees. The inner walls 64 of the flared ends 62 are rounded. These two features allow the airflow to accelerate gradually, thereby reducing the pressure losses and increasing the efficiency of the premixing injector 10. The air inlet ducts 60 deliver the compressor air into the premixing injector 10. The air inlet ducts 60 are also at an angle of preferably 60 degrees relative to the axial flow direction to reduce the pressure losses.

Referring now to FIGS. 2 and 3, the center body 20 is a generally cylindrical structure having a first open end 22 and a second closed end 24. As illustrated in FIG. 2, the second end includes an endcap 30. The center body 20 includes an exterior wall 26 and an interior wall 28. The exterior annular mixing channel 40 is created between the internal surface 18 of the outer casing 12 and the exterior wall 26 of the center body 20 and forms the exterior annular mixing channel 40.

As illustrated in FIG. 2, the first open end 22 of the center body 20 includes a sold annular sleeve 23 with a larger diameter such that the diameter of the annular sleeve 23 is approximately the same as the internal diameter of the outer casing 12. This allows for a smooth press fit between the center body 20 and the outer casing 12.

The transition zone between the exterior wall 26 and the choked fuel injection point 54 is known as the constant radius fillet 56. The constant radius fillet 56 is necessary to reduce the pressure losses in the premixing injector 10. The constant radius fillet 56 reduces the area for separation for the inlet air stream, and helps gradually turn the airflow. The air enters from the air inlet ducts 60 and the constant radius fillet 56 guides the flow axially.

The fuel enters from the choked fuel injection port 54 and enters the exterior annular mixing channel 40 at the area of the constant radius fillet 56. The smoother this transition, the less pressure loss occurs. Therefore, a curved radius of the constant radius fillet 56 is preferable to a right angle. It allows smoother blending of the gas/air mixture. The choked fuel injector ports 54 are choked to eliminate the possibility of downstream pressure fluctuations from propagating upstream into the fuel delivery system.

The fully assembled premixing injector 10 contains a series of chambers within the premixing injector 10 including the open passageway 48 of the fuel inlet duct 42, the interior fuel channel 50, a plenum 62, and the exterior annular mixing channel 40. In addition, there is a choked fuel injection port 54 formed between the plenum 62 and the exterior annular mixing channel 40.

The fuel system will be at an elevated pressure to satisfy the choked flow requirement in the fuel injection ports 60 and the overall fuel mass flow requirement. The plenum 62 is an open area designed to settle out velocity profiles of the fuel.

In the exterior annular mixing channel 40, the fuel/air mixture has both a tangential and axial velocity component creating a swirling structure. The air inlet ducts 60 are positioned such that the air enters the exterior annular mixing channel 40 at an angle which forces the air and fuel mixture to propagate through the exterior annular mixing channel 40 in a helical fashion. The swirl of the air/fuel mixture and the fact that the mixture is premixed is important in keeping the flame shortened in the combustor 90.

Operation

The fuel, generally pressurized gaseous fuel, enters the fuel inlet duct 42 of the premixing injector 10 via the fuel inlet duct 48. The fuel then travels the length of the passageway 48 to the conduit 52 where the fuel provides back wall cooling to the endcap 30 of the center body 20. Backwall cooling reduces the thermal load on the center body 20. This prolongs the life of the premixing injector 10. Another term for this process is "regenerative cooling."

Once the fuel reaches the endcap 30, it is channeled from the passageway 48 to the interior fuel channel 50 via the conduit 52 and toward the plenum 62, thereby increasing the heat transfer to the fuel, and conditioning internal velocity profiles.

At the plenum 62 area, the fuel flows through the choked fuel injection ports 54 into the exterior annular mixing channel 40 at the area of the constant radius fillet 56 where the compressor discharge air entering through the air inlet ducts 60 is mixed with the fuel. The choked fuel injection port 54 eliminates the possibility that downstream pressure fluctuations will affect the fuel delivery flow rate. Additionally, the high-speed fuel jet penetrates farther into the incoming air stream because the momentum ratio (fuel jet/air) is high. This enhances the mixing between the two streams.

At this point, the fuel air mixture propagates in a helical vortex structure around the exterior surface 26 of the center body 20 in the exterior annular mixing channel 40 toward the exit end 80 of the premixing injector 10 where it is passed into the engine. This feature is important for flame placement. The design velocities are such that flashback is eliminated. Finally, the fuel/air mixture, now fully premixed and swirling, enters the combustion region through the exit end.

The premixing injector 10 provides a swirling and well-mixed reactant stream of fuel and air to the combustor. The premixing injector 10 produces stable combustion and low $NO_x$ emissions. The current design was sized to accommodate hydrogen as a fuel; however it is within the scope of the present invention to consider other forms of gas, such as natural gas with or without hydrogen, gas mixtures resulting from coal gasification, ethylene, propane and other forms of gaseous fuel with this design.

Figure 4:
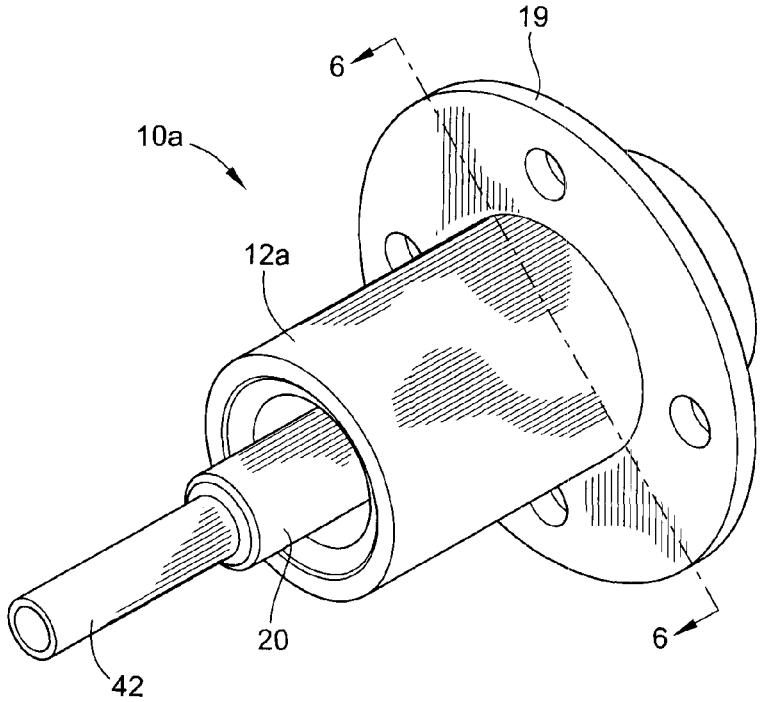
FIG. 4 is a perspective view of a second embodiment of the premixing injector of the present invention ("Embodiment 2").
Figure 5:
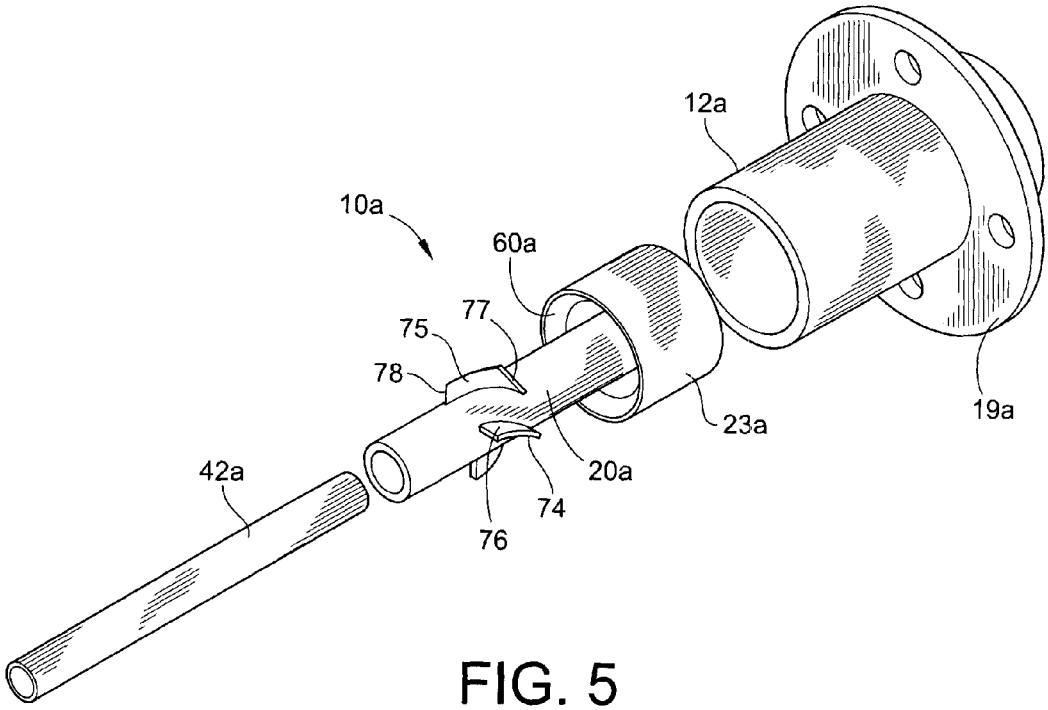
FIG. 5 is an exploded view of the premixing injector of FIG. 4.
Figure 6:
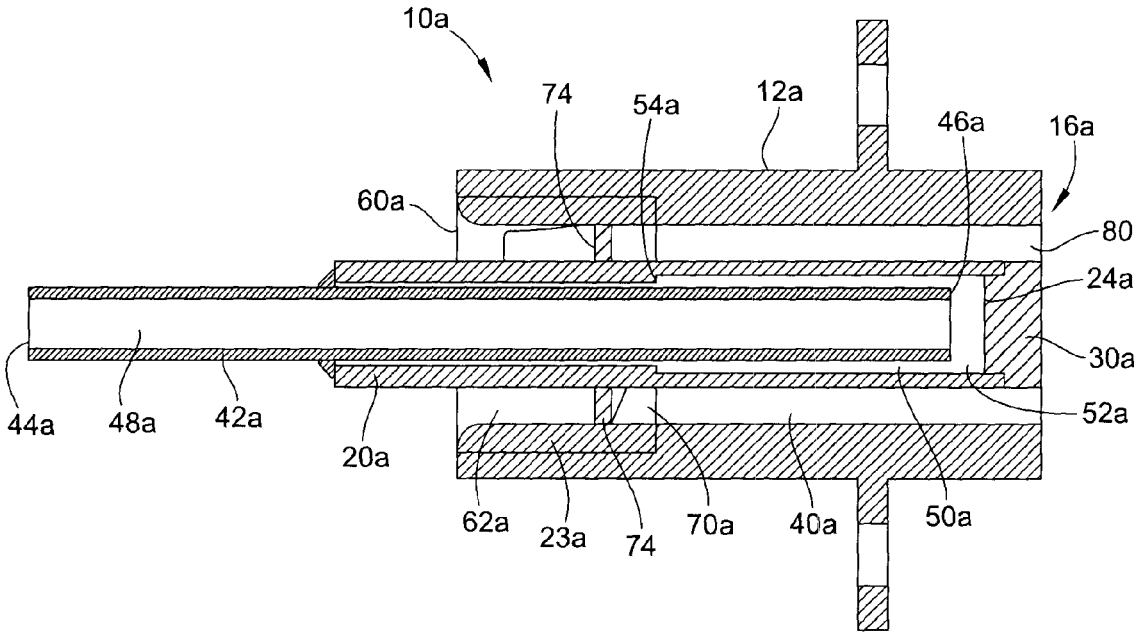
FIG. 6 is a cross-sectional view of the premixing injector of FIG. 4 taken along lines 6-6 of FIG. 4.

Reference is now made to FIGS. 4-6 for an alternative Embodiment 2 of the premixing injector of the present invention. Referring to FIG. 4, the premixing injector 10*a* is comprised of an outer casing 12*a*, a center body 20*a* having an exterior wall 26*a*, between which is defined the exterior annular mixing channel 40*a*, and a fuel inlet duct 42*a*.

A plurality of air guide vanes 74 are securely affixed to the center body 20*a* and extend radially outward from the center body 20*a* toward the outer casing 12*a*. Each vane 74 has an inner end 75 and an outer end 76. The inner end 75 is proximate to the center body 20*a* relative to the outer end 76. Each vane 74 includes a leading edge 78 and a trailing edge 77. The leading edge 78 is upstream of the flow path relative to the trailing edge 77, which is downstream of the leading edge 78. The vane 74 is radially arranged with respect to the center body 20*a* to facilitate manufacturing and produce the required flow. Each vane 74 is curved in the same direction.

The purpose of these guide vanes 74 is to add structural support to the premixing injector 10*a* as well as to provide the desired tangential and axial velocity components to the air entering the premixing injector 10*a*. The vanes 74 are designed to produce a specific radial equilibrium condition to control the swirling velocity distribution and minimize flow losses. Air enters the exterior annular mixing channel 40*a* upstream of the guide vanes 74 at the swirl region 70*a* and, following mixing with the injected fuel, exits the premixing injector 10*a* at the downstream end 16*a* of the exterior annular mixing channel 40*a*.

Gaseous fuel enters the premixing injector 10*a* through the passageway 48*a* within the fuel inlet duct 42*a* and is introduced to the exterior annular mixing channel 40*a* through choked radial fuel ports 54*a*, initiating mixing with the passing air stream. Before the gaseous fuel reaches the passing air stream, it will be accelerated to sonic velocities through the radial fuel ports 54*a*. The gaseous fuel is introduced into the airflow downstream of the guide vanes 74 to eliminate the possibility of flame stabilization inside the premixing injector 10*a*.

The combustion zone is expected to stabilize downstream of the exterior annular mixing channel 40*a*. With the combustion zone close to the exterior annular mixing channel 40*a*, the endcap 30*a* of the center body 20*a* will experience high temperatures. To counter this effect, the premixing injector 10*a* is designed to transfer heat from the endcap 30*a* of the center body 20*a* to the incoming gaseous fuel. After the fuel enters the core of the center body 20*a*, it is directed toward the endcap 30*a* of the center body 20*a* where heat transfer occurs. This provides a form of regenerative cooling for the second closed end 24 of the center body 20*a*.

Figure 7:
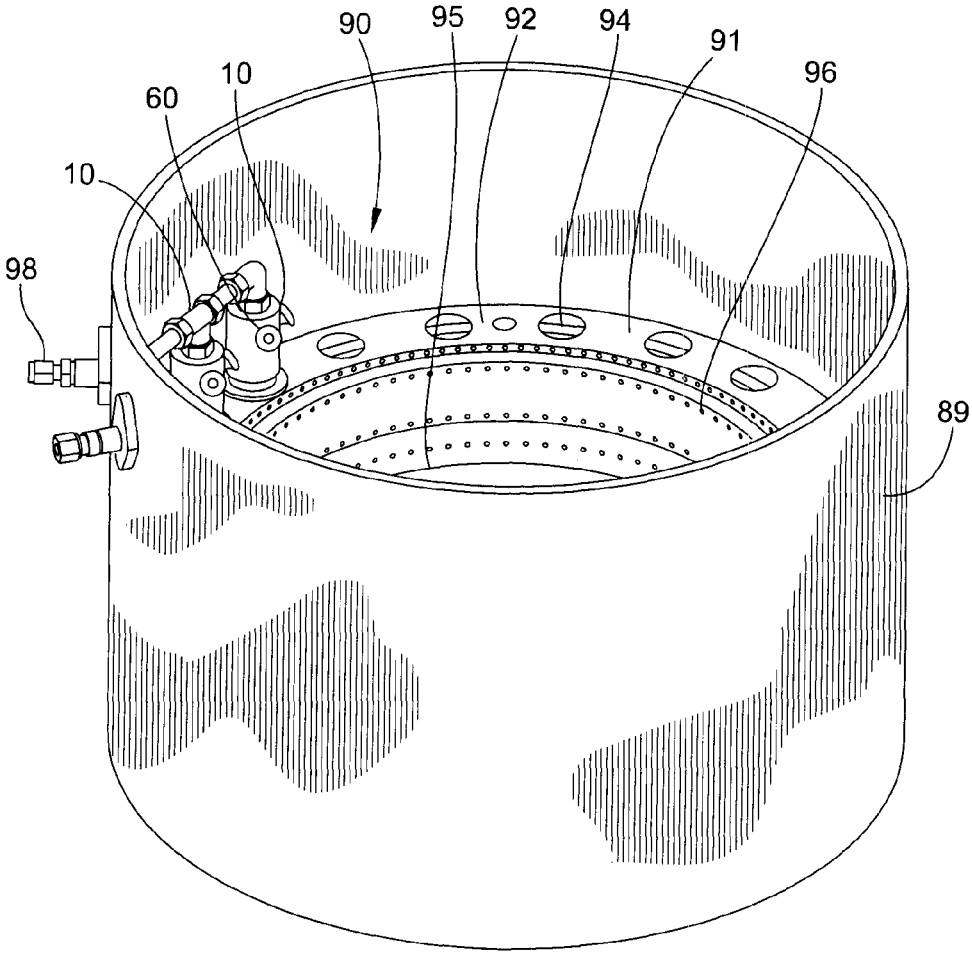
FIG. 7 is a partial perspective view of a combustor illustrating the positioning of the premixing injectors of the present invention.

Reference is now made to FIG. 7 which illustrates a gas turbine engine pressure casing 89. The pressure casing 89 encompasses the combustor 90 which contains the annular combustion liner 91. The combustion liner 91 is conventional in design and will not be described in detail except to note that the combustion liner 91 may be modified to ensure that the desired amount of the compressor discharge air flows through the premixing injectors 10 and the combustion liner 91 once the premixing injectors 10 are installed. Two premixing injectors 10 are shown in FIG. 7. However it is within the scope of the present invention to include one or a plurality of premixing injectors 10 depending on the requirements of the gas turbine engine. Multiple combustion chambers 90 can also be provided, if necessary or desirable. In addition, while the premixing injector 10 will be described with respect to the combustion liner 91, it should also be understood that premixing injector 10*a* can also be provided with the combustion chamber 91.

The combustion liner 91 is generally defined as a sheet metal object which is generally annular in shape that has a domed end 92 with circular openings 94 of a size and shape to receive the premixing injector 10. The combustion liner 91 must be matched with the premixing injectors 10. For example, the openings 94 can be slightly larger than the outer diameter of the premixing injector 10 to allow a small amount of cooling compressor discharge air to flow around the outer casing 12 of the premixing injector 10 to allow for management of the combustion liner 91 temperature. This could take advantage of the fact that a premixed flame utilizing gaseous fuel is much shorter than a diffusion flame. The premixing injectors 10 will remain in the correct orientation through the use of two locator pins (not illustrated) per premixing injector 10.

Opposite the domed end 92 on the combustion liner 91, there is an open end 95 which allows the combustion products exiting the combustion liner 91 to enter the turbine guide vanes (not illustrated). If desired, dilution air inlets 96 are present in the combustion liner 91 to introduce additional compressor discharge air to prevent the excessive heating of the combustion liner 91 itself due to the combustion process, and to cool the combustion products sufficiently so as not to destroy the turbine vanes and blades.

In operation, the fuel, e.g., hydrogen, enters a fuel manifold port 98. Each fuel manifold port 98 is connected to a hydrogen or fuel source (not illustrated). Each fuel manifold port 98 is in turn connected to the fuel inlet duct 42 of the premixing injector to admit the fuel through the premixing injector 10 and allow mixing with the compressor discharge air entering through the air inlet ducts 60 as described above. The thoroughly mixed and swirling fuel/air mixture exits the premixing injectors 10 through the second end 16 within the openings 94 in the domed end 92 of the combustion liner 91 wherein it is diverted via a series of baffles (not illustrated) known to the art through the combustion chamber 90 to the turbine inlet.

Example

The following Example is included solely for the purpose of providing a more complete and consistent understanding of the invention disclosed and claimed herein. The Example does not limit the scope of the invention in any fashion.

The design specifications for the premixing injector 10 enabled its use in a Pratt and Whitney PT6-20 turboprop engine. Since varying operating conditions of the engine (take off, cruise, and full power) are possible, there are multiple possible optimizations for the injector. The cruise condition was chosen for the optimization due to the normal high percentage of operational time at cruise. Table 1 shows the overall design constraints and the constraints per nozzle for the cruise condition of the engine. The fuel flow rate was determined by the equivalent energy flow rate based on lower heating value of hydrogen and kerosene. The number of premixing injectors 10 was chosen to ensure relative spatial uniformity in the engine liner. The equivalence ratio constraint is from a desire to have low emissions. These constraints define the flow rates of both the fuel and air to each premixing injector 10. Using the aforementioned tangential entry swirl design concept, a prototype was developed.

TABLE 1

Overall design Constraints for the Premixing Injector 10

| Design Constraint | Value |
|---|---|
| Power | 410 kW |
| Fuel flow rate | 14.5 g/s |
| Equivalence Ratio | 0.4 |
| Number of Nozzles | 18 |
| Upstream Pressure | 537 kPa |

The engineering design process needed both the listed quantities above and additional design constraints. The constraints that were added include the following: the axial velocity within the premixing injectors 10 must exceed 100 m/s, the swirl number must be above 0.8 for a "high swirl" injector, pressure losses must not exceed 10%, and there must not be any instability in the operational range of the injector. The high swirl number and the high velocity requirement were set such that the flame will stabilize outside the nozzle in the shear layer between the vortices and not within the injector. The pressure loss requirement is present because pressure losses are parasitic to the engine efficiency and must be minimized. Finally, the instability requirement is present because in the presence of instabilities pressure forces can damage hardware, the increased convection and radiation has the potential of melting the hardware, and local regions with high equivalence ratios are formed, raising emissions, and the overall combustion efficiency decreases.

Referring to FIGS. 1-3, the four air inlet ports 60 are designed such that the fabrication would necessitate standard ¼" tubing. The minor diameter of the air inlet ports 60 is 4.57 mm and has a 45° rounded bell mouth opening 64. The reason for the opening 64 is to accelerate the compressor discharge air flow gradually and reduce the pressure losses associated with the air inlet ports 60. The fuel inlet duct 42 is oriented in the axial direction, located at the upstream end of the premixing injector 10.

Another feature that reduces the pressure loss is located inside the swirler region 70, illustrated in FIG. 3. Early simulations showed that the area near the first inlet end 14 of the premixing injector 10 at the center body 20 caused a significant separation zone and a void where fuel/hydrogen accumulation was possible. A 6.25 mm constant radius fillet 56 was placed on the center body 20 to fill the void and gradually turn the mixing flow into the swirler region 70.

The swirler region 70 has an outer diameter of 21.18 mm and an inner diameter of 15.24 mm, yielding an exit area of 0.0001699 $m^2$. Using the mass flow rate and the area, the area average velocity is approximately 113 m/s based on ideal gas behavior. This high velocity is good flashback prevention because the turbulent flame speed will not approach such a high value.

The fuel side design decisions were made as precautions to address failures and problems typically seen in premixing injectors 10. With the flame zone for a premixing injector 10 being close to the end cap 30 of the center body 20, there is potential for the thermal failure of the endcap 30. To alleviate this problem the hydrogen fuel provides convective back wall cooling before it is introduced into the exterior annular mixing channel 40. To achieve this, the fuel is routed from the open passageway 48 of the fuel inlet duct 42 to conduit 52 located at the endcap 30 of the center body 20. Here, the fuel provides the back wall cooling to the endcap 30 and is routed to the plenum 62 of the premixing injector 62, and finally through the exterior annular mixing channel 40 to the downstream end 16 of the premixing injector 10.

To circumvent thermoacoustic instabilities in the combustor 90 caused by equivalence ratio perturbations associated with acoustic wave propagated upstream through the fuel delivery system, the premixing injector 10 is provided with choked radial fuel ports 54 (Mach=1). Choking the radial fuel ports 54 eliminates the possibility for equivalence ratio perturbations, but mixing perturbations can still exist leading to instabilities. It is however important that the bulk mixing qualities remain constant, which are determined in part by the momentum flux ratio defined as $$j = \frac{\rho_f V_f^2}{\rho_a V_a^2}$$

where the subscripts a and f refer to the air and fuel respectively. In a choked passage the mass flow rate is determined by the pressure, which positively correlates to the density. It is important that the fuel stream does not over penetrate into the air crossflow, thus disrupting the mixing processes. Therefore the area of the choked radial fuel ports 54 was chosen to be the largest area in which the passage remained choked during the idle condition of the gas turbine engine. The idle condition of the gas turbine engine is the lowest mass flow rate of fuel that is required. The calculated choked radial fuel port size is 0.406 mm. The diameter ratio between the air inlet ports 60 and the choked radial fuel ports 54 is 11.24, which is relatively small. A benefit for making the choked radial fuel ports 54 larger is that the surface area on the windward side of the fuel jet becomes large, aiding in the fuel shedding and mixing process. An additional benefit of maximizing the choked radial fuel ports 54 is that the fuel inlet pressure is minimized. This could potentially be a parasitic loss on the engine power, depending on the storage method of the hydrogen.

In summary, the design choices for the premixing injector 10 were all derived from the gas turbine engine requirements. The power desired at cruise needed determined the design flow rate of hydrogen/fuel. The equivalence ratio specification to reduce $NO_x$ determined the air flow rate and thus the exterior annular mixing channel 40, 40*a* cross-sectional area.

It is understood that the invention is not confined to the particular construction and arrangement of parts herein illustrated and described, but embraces such modified forms thereof as come within the scope of the following claims. Thus, the invention encompasses all different versions that fall literally or equivalently within the scope of the claims.

What is claimed is:

1. A premixing injector, comprising:

a. an outer casing having a first inlet end, a second outlet end, an interior wall, and an exterior wall;

b. a center body having a first open end extending from the first inlet end of the outer casing, a second closed end at the second outlet end of the outer casing, an exterior wall, an interior wall and an endcap, wherein the second closed end of the center body is substantially co-planar with the second outlet end of the outer casing;

c. an annular sleeve on the center body wherein the annular sleeve is dimensioned and configured for placing the center body within the outer casing;

d. an exterior annular mixing channel defined by the exterior wall of the center body and the interior wall of the outer casing;

e. an air inlet port dimensioned and configured to channel compressor discharge air to the exterior annular mixing channel;

f. a fuel inlet duct extending from the first open end to the second closed end of the center body, the fuel inlet duct having a first inlet end, a second outlet end, and an open passageway extending from the first open end to the second closed end, wherein the fuel inlet duct is positioned within the center body to define an interior fuel channel connected to the open passageway by a conduit, wherein the interior fuel channel extends longitudinally and in substantially parallel alignment with the exterior annular mixing channel from the conduit to a choked fuel injection port, wherein the choked fuel injection port is dimensioned and configured to introduce fuel to the exterior annular mixing channel;

g. a swirler region defined within the exterior annular mixing channel, wherein the swirler region is dimensioned and configured for mixing fuel and compressor discharge air; and h. an outlet for expelling swirled and mixed fuel and air.

2. The premixing injector of claim 1 wherein the air inlet port comprises at least one air inlet duct for channeling compressor discharge air to the exterior annular mixing channel.

3. The premixing injector of claim 2 wherein the air inlet duct is a bell mouth-shaped inlet affixed to the outer casing of the premixing injector.

4. The premixing injector of claim 2 wherein the air inlet port comprises four substantially tangential and substantially circular air inlet ducts having first ends attached to the outer casing of the premixing injector, and second ends wherein the second ends are flared at an angle.

5. The premixing injector of claim 4 wherein the second ends of the air inlet ducts are flared at substantially a 45 degree angle with respect to the premixing injector.

6. The premixing injector of claim 1 wherein the swirler region includes a plurality of serpentine guide vanes positioned within the annulus formed by the outer casing and the center body and extending axially to the exterior annular mixing channel.

7. The premixing injector of claim 6 wherein the guide vanes include a discharge angle defined by a selected radial equilibrium condition to be substantially 45-60 degrees with respect to the axis of the outer casing.

8. The premixing injector of claim 1 wherein the outer casing includes a flange dimensioned and configured to attach the premixing injector to a combustor liner.

9. The premixing injector of claim 4 further comprising a constant radius fillet transition zone defined within the swirler region wherein the constant radius fillet is dimensioned and configured to reduce pressure losses in the premixing injector.

10. A premixing injector, comprising:

a. an outer casing having a first inlet end, a second outlet end, an interior wall, and an exterior wall;

b. a center body having a first open end extending from the first inlet end of the outer casing, a second closed end at the second outlet end of the outer casing, an exterior wall, an interior wall and an endcap, wherein the second closed end of the center body is substantially co-planar with the second outlet end of the outer casing;

c. a solid annular sleeve on the center body wherein the annular sleeve is dimensioned and configured for placing the center body within the outer casing;

d. an exterior annular mixing channel defined by the exterior wall of the center body and the interior wall of the outer casing;

e. an air inlet duct dimensioned and configured to channel compressor discharge air to the exterior annular mixing channel, wherein the air inlet duct is a bell mouth-shaped inlet affixed to the outer casing of the premixing injector;

f. a fuel inlet duct extending from the first open end to the second closed end of the center body, the fuel inlet duct having a first inlet end, a second outlet end, and an open passageway extending from the first open end to the second closed end, wherein the fuel inlet duct is positioned within the center body to define an interior fuel channel connected to the open passageway by a conduit, wherein the interior fuel channel extends longitudinally and in substantially parallel alignment with the exterior annular mixing channel from the conduit to a choked fuel injection port, wherein the choked fuel injection port is dimensioned and configured to introduce fuel to the exterior annular mixing channel;

g. a swirler region defined within the exterior annular mixing channel, wherein the swirler region is dimensioned and configured for mixing fuel and compressor discharge air;

h. a constant radius fillet transition zone defined within the swirler region wherein the constant radius fillet is dimensioned and configured to reduce pressure losses in the premixing injector; and i. an outlet for expelling swirled and mixed fuel and air.

11. The premixing injector of claim 10 wherein the air inlet duct comprises four tangential circular air inlet ports having first ends attached to the outer casing of the premixing injector, and second ends wherein the second ends are flared at an angle with respect to the premixing injector.

12. The premixing injector of claim 11 wherein the second ends of the air inlet ports are at a substantially 45 degree angle.

13. A premixing injector, comprising:

a. an outer casing having a first inlet end, a second outlet end, an interior wall, and an exterior wall;

b. a center body having a first open end extending from the first inlet end of the outer casing, a second closed end at the second outlet end of the outer casing, an exterior wall, an interior wall and an endcap, wherein the second closed end of the center body is substantially co-planar with the second outlet end of the outer casing;

c. a hollow annular sleeve on the center body wherein the annular sleeve is dimensioned and configured for placing the center body within the outer casing;

d. an exterior annular mixing channel defined by the exterior wall of the center body and the interior wall of the outer casing;

e. an air inlet duct dimensioned and configured to channel compressor discharge air to the exterior annular mixing channel, wherein the air inlet duct is a bell mouth-shaped inlet affixed to the outer casing of the premixing injector;

f. a fuel inlet duct dimensioned and configured within the center body to define an interior fuel channel connected to the open passageway by a conduit, wherein the interior fuel channel extends longitudinally and in substantially parallel alignment with the exterior annular mixing channel from the conduit to a choked fuel injection port, wherein the choked fuel injection port is dimensioned and configured to introduce fuel to the exterior annular mixing channel;

g. a swirler region defined within the exterior annular mixing channel, wherein the swirler region includes guide vanes dimensioned and configured for mixing fuel and compressor discharge air;

h. a constant radius fillet transition zone defined within the swirler region wherein the constant radius fillet is dimensioned and configured to reduce pressure losses in the premixing injector; and i. an outlet for expelling swirled and mixed fuel and air.

14. The premixing injector of claim 13 wherein the swirler region includes a plurality of serpentine guide vanes extending from the exterior wall of the center body in an axial relationship to the exterior annular mixing channel.

15. The premixing injector of claim 13 wherein the guide vanes include a discharge angle defined by a selected radial equilibrium condition to be substantially 45-60 degrees with respect to the axis of the outer casing.

16. The premixing injector of claim 13 wherein the outer casing includes a flange dimensioned and configured to attach the premixing injector to a combustor liner.

* * * * *